US006903643B2

(12) United States Patent
Lee et al.

(10) Patent No.: US 6,903,643 B2
(45) Date of Patent: Jun. 7, 2005

(54) LAMINATED BALUN TRANSFORMER

(75) Inventors: Byoung Hwa Lee, Kyungki-do (KR); Nam Chul Kim, Daejeon (KR); Jeong Ho Yoon, Kyungki-do (KR); Sang Soo Park, Kyungki-do (KR); Dong Seok Park, Seoul (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 48 days.

(21) Appl. No.: 10/462,748

(22) Filed: Jun. 17, 2003

(65) Prior Publication Data

US 2004/0119573 A1 Jun. 24, 2004

(30) Foreign Application Priority Data

Dec. 23, 2002 (KR) ..... 10-2002-0082878

(51) Int. Cl.[7] ..... H01F 5/00
(52) U.S. Cl. ..... 336/200; 336/232; 336/223
(58) Field of Search ..... 336/200, 232, 336/223; 29/601.2

(56) References Cited

U.S. PATENT DOCUMENTS 6,285,273 B1 9/2001 Morikawa
6,388,551 B2 * 5/2002 Morikawa ..... 336/223
6,628,189 B2 * 9/2003 Yazaki et al. ..... 336/200

* cited by examiner

*Primary Examiner*—Anh Mai
(74) *Attorney, Agent, or Firm*—Lowe Hauptman & Berner, LLP

(57) ABSTRACT

A balun transformer includes a structure with three .lambda./4 strip lines for converting an unbalanced signal in an unbalanced transmission line into a balanced signal in a balanced transmission line. The balun transformer includes a first dielectric sheet on which a first strip line provided, a second dielectric sheet placed under the first dielectric sheet and on which a second strip line electro-magnetically coupled to the first strip line is provided, a third dielectric sheet placed under the second dielectric sheet and on which a ground pattern is provided, and a fourth dielectric sheet placed under the third dielectric sheet and on which a third strip line is provided. The balun transformer includes the reduced number of strip lines in comparison with the conventional laminated balun transformer, so that the production cost is reduced.

20 Claims, 7 Drawing Sheets

LAMINATED BALUN TRANSFORMER

BACKGROUND OF THE INVENTION

1. Field of the Invention

The present invention relates to a laminated balun transformer, more particularly to a laminated balun transformer realized by a structure including three λ/4 strip lines, thereby reducing a size thereof.

2. Description of the Related Art

"Balun" stands for BALanced to UNbalanced. A balun transformer is a balanced-unbalanced signal converter for converting a balanced signal in a balanced transmission line into an unbalanced signal in an unbalanced transmission line and vice versa.

Such balun transformer is used for connecting a component such as a mixer and a Surface Acoustic Wave (SAW) filter using balanced signals, which are widely used in wireless signal processing units, and a component such as an amplifier using unbalanced signals.

A balun transformer is usually implemented by combining a plurality of distribution constant transmission lines or concentrated constant transmission lines. Further, the balun transformer can by realized by resonance waveguides when the balun transformer is applied in the antenna field.

U.S. Pat. No. 6,285,273 issued to Takehiko Morikawa and titled "Laminated Balun Transformer" discloses a conventional laminated balun transformer comprising a plurality of strip lines vertically stacked.

With reference to FIG. 7 and FIG. 8, a conventional laminated balun transformer 101 comprises four dielectric sheets 102*c*, 102*d*, 102*f*, 102*g* on which four strip lines 104, 105, 108, 109 are provided, respectively, three dielectric sheets 102*a*, 102*e*, 102*h* on which ground electrodes 112, 113, 114 are provided, respectively, and a dielectric sheet 102*b* on which a lead electrode 103 is provided.

Of a first, second, third and fourth strip lines 105, 106, 108, 109, the first and second strip lines 105, 106, and the third and fourth strip lines 107, 108 are electro-magnetically coupled together to form two pairs of electro-magnetically coupled strip lines. The second and third strip lines 106, 108 are electrically connected to a ground electrode 113 at respective ends 120*b*, 108*b* thereof through a via hole.

All the ground electrodes 112, 113, 114 are connected to all the external electrodes 125, 129, 132 in common. The first strip line 104 is connected to an external electrode 131 through the lead electrode 103 at an end thereof, and further connected to an external electrode 128 at the other end thereof. The strip lines 105, 108 are connected to the ground electrode 113 at an end thereof and connected to external electrodes 127, 126, respectively at the other ends thereof. The fourth strip line 109 is connected to the external electrode 128 at an end thereof, and is opened at the other end thereof. That is, the first strip line 104 and the fourth strip line 109 are electrically connected to each other through the external electrode 128.

The external electrodes 125, 129 and 132 serve as ground electrodes, the external electrodes 126, 127 serve as output terminals for balanced signals, and the external electrode 31 serves as an input terminal for an unbalanced signal.

FIG. 9 illustrates an electric equivalent circuit diagram of the laminated balun transformer shown in FIGS. 7 and 8.

The conventional laminated balun transformer with reference to FIGS. 7 to 9 are realized by using four λ/4 strip lines and two couplers, so that a large number of external electrodes are needed, and a configuration and structure of the laminated balun transformer are complicated.

SUMMARY OF THE INVENTION

Therefore, the present invention has been made in view of the above problems, and it is an object of the present invention to provide a laminated balun transformer for converting an unbalanced signal line in an unbalanced transmission line into a balanced signal, the laminated balun transformer being realized by a structure including three λ/4 strip lines.

In accordance with one aspect of the present invention, the above and other objects can be accomplished by the provision of a laminated balun transformer comprising: a first dielectric sheet on a surface of which a first strip line is provided; a second dielectric sheet placed under the first dielectric sheet and on a surface of which a second strip line electro-magnetically coupled to the first strip line is provided; a third dielectric sheet placed under the second dielectric sheet and on a surface of which a ground pattern is provided; and a fourth dielectric sheet placed under the third dielectric sheet and on a surface of which a third strip line is provided.

Preferably, the laminated balun transformer further comprises an external connection electrode formed on an external surface of a body forming the laminated balun transformer, wherein the second strip line and the third strip line are electrically connected to each other through the external connection electrode.

Preferably, the laminated balun transformer further comprises an unbalanced signal input electrode, a first and second balanced signal output electrodes and a ground electrode formed on corresponding external surfaces of a body forming the laminated balun transformer, wherein the first strip line is connected to the ground electrode at an end thereof and connected to the unbalanced signal input electrode at the other end thereof, and the first and second strip lines electrically connected to each other have respective ends which are connected to the first and second balanced signal output electrodes, respectively.

Preferably, the laminated balun transformer further comprises: a fifth dielectric sheet on which a first lead electrode for connecting the first strip line to the unbalanced signal input electrode is provided; a sixth dielectric sheet on which a second lead electrode for connecting the second strip line to the first balanced signal output electrode is provided; and a seventh dielectric sheet on which a third lead electrode for connecting the third strip line to the second balanced signal output electrode is provided.

Preferably, the laminated balun transformer further comprises an eighth and a ninth dielectric sheets serving as an uppermost layer and a lowermost layer, respectively, and on which respective ground electrodes are provided.

In accordance with another aspect of the present invention, there is provided with a laminated balun transformer comprising: an unbalanced signal electrode through which an unbalanced signal is input and output; a first and second balanced signal electrodes through which a first and second balanced signals are input and output; a ground electrode connected to ground voltage; a first dielectric sheet on which a first strip line is provided, the first strip line having an end connected to the unbalanced signal electrode and the other end connected to the first strip line; and a second dielectric sheet on which a second and a third strip lines is provided, the second and third strip lines having respective first ends connected to each other and respective second ends connected to the first and second balanced signal electrodes, respectively, wherein one strip line of the second and third strip lines is partially overlapped with the first strip line.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

A detailed description of a laminated balun transformer in accordance with preferred embodiments of the present invention will be given below with reference to the accompanying drawings.

Figure 1:
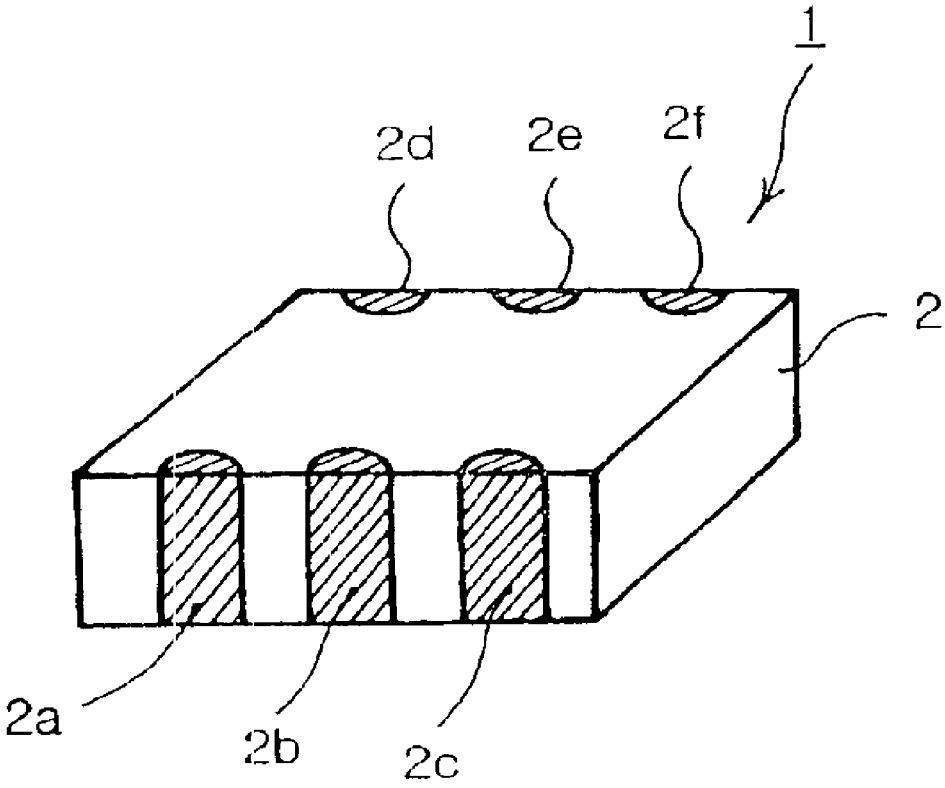
FIG. 1 illustrates a perspective view of a laminated balun transformer showing an external form thereof in accordance with a preferred embodiment of the present invention.

FIG. 1 illustrates a perspective view of a laminated balun transformer in accordance with a preferred embodiment of the present invention.

Referring to FIG. 1, a laminated balun transformer 1 in accordance with the first embodiment of the present invention comprises a dielectric block 2 having a hexahedral shape, or a cube shape, unbalanced signal input electrode 2*a*, a first and second balanced signal output electrodes 2*c*, 2*f*, and a non-contact (NC) electrode 2*d* which are formed on corresponding external side surfaces of the dielectric block 2.

The dielectric block 2 is comprised of a plurality of dielectric sheets sequentially stacked.

Figure 2:
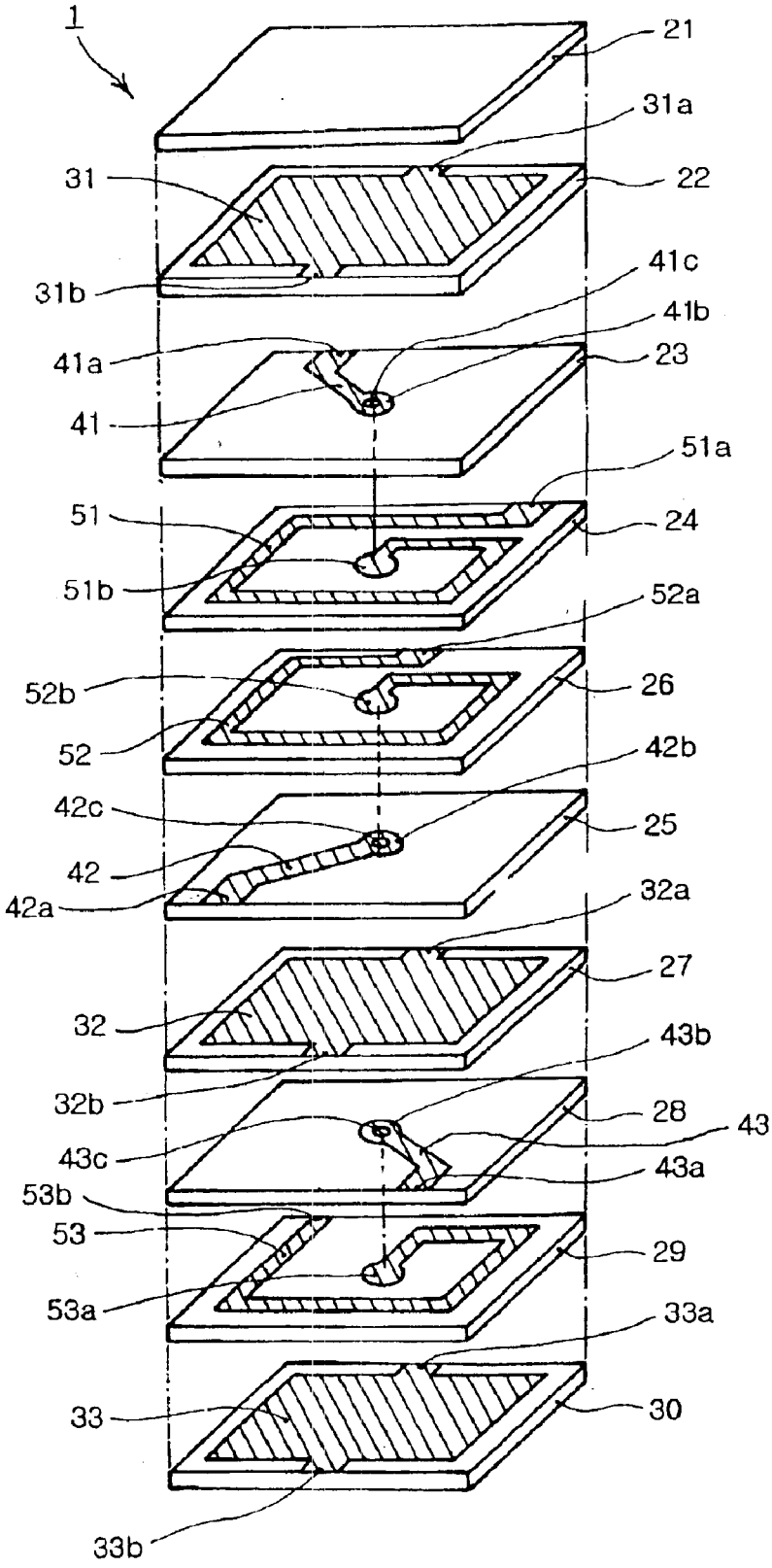
FIG. 2 illustrates an exploded, perspective view showing an internal structure of a laminated balun transformer in accordance with the preferred embodiment of the present invention.

Referring to FIG. 2, the laminated balun transformer 1 comprises a first dielectric sheet 24 on which a first strip line 51 is provided, a second dielectric sheet 26 on which a second strip line 52 is provided and which is arranged in parallel with the first dielectric sheet 24 on or under the first dielectric sheet 24, a third dielectric sheet 27 on which a ground electrode 32 is provided, and a fourth dielectric sheet 29 on which a third strip line 53 is provided and which is electro-magnetically separated from the first and second dielectric sheet 24, 26 by the third dielectric sheet 27.

The dielectric sheets 24, 26, 27, 29 may be sequentially stacked in order of the first dielectric sheet 24, the second dielectric sheet 26, the third dielectric sheet 27 and the fourth dielectric sheet 29, and may be stacked in order of the second dielectric sheet 26, the first dielectric sheet 24, the third dielectric sheet 27 and the fourth dielectric sheet 29.

That is, the third dielectric sheet 27 having the ground electrode 32 thereon is interposed between the first and second dielectric sheets 24, 26 and the fourth dielectric sheet 27, so as for the fourth dielectric sheet 27 to be electro-magnetically separated from the first and the second dielectric sheets 24, 26.

The laminated balun transformer with reference to FIG. 1 further comprises a fifth, a sixth and a seventh dielectric sheets 23, 25, 28 on which lead electrodes 41, 42, 43 are provided, respectively. The lead electrodes 41, 42, 43 connect the respective first, second and third strip lines 51, 52, 53 to corresponding external electrodes 2*a*, 2*c*, 2*d*, 2*f*.

The first lead electrode 41 is connected to the NC electrode 2*d* at a first end 41*a* thereof and connected to the first strip line 51 at a second end 41*b* thereof through a via hole 41*c* formed at a second end 51*b* of the first strip line 51, thereby connecting the first strip line 51 to the NC electrode 2*d*.

The second lead electrode 42 is connected to the unbalanced signal input electrode 2*a* at a first end 42*a* thereof and connected to a second end 52*b* of the second strip line 52 at a second end 42*b* thereof through a via hole 42*c*, thereby transferring an unbalanced signal input from the unbalanced signal input electrode 2*a* to the second strip line 52.

The third lead electrode 43 is connected to the first balanced signal output electrode 2*c* at a first end 43*a* thereof and connected to a first end 53*a* of the third strip line 53 at a second end 43*b* thereof through a via hole 43*c*, thereby transferring a first balanced signal generated at a second end 53*b* of the third strip line 53 to the first balanced signal output electrode 2*c*.

Further, the first strip line 51 is directly connected to the second balanced signal output electrode 2*f* at a first end 51*a* thereof, the second strip line 52 is directly connected to the ground electrode at a first end 52*a* thereof, and the third strip line is directly connected to the NC electrode 2*d* at a second electrode 53*b* thereof.

The laminated balun transformer 1 in accordance with the preferred embodiment of the present invention further comprises an eighth and a ninth dielectric sheets 22, 3Q, each having respective ground electrodes 31, 33 on a surface of an internal part thereof.

Further, in the case of modifying patterns of the first, second and third strip lines 51, 52 and 53, the first, second and third strip lines 51, 52 and 53 can be connected to the corresponding external electrodes 2*a*, 2*b*, 2*c*, 2*d*, 2*e* and 2*f* without using the lead electrodes 41, 42 and 43.

Figure 3:
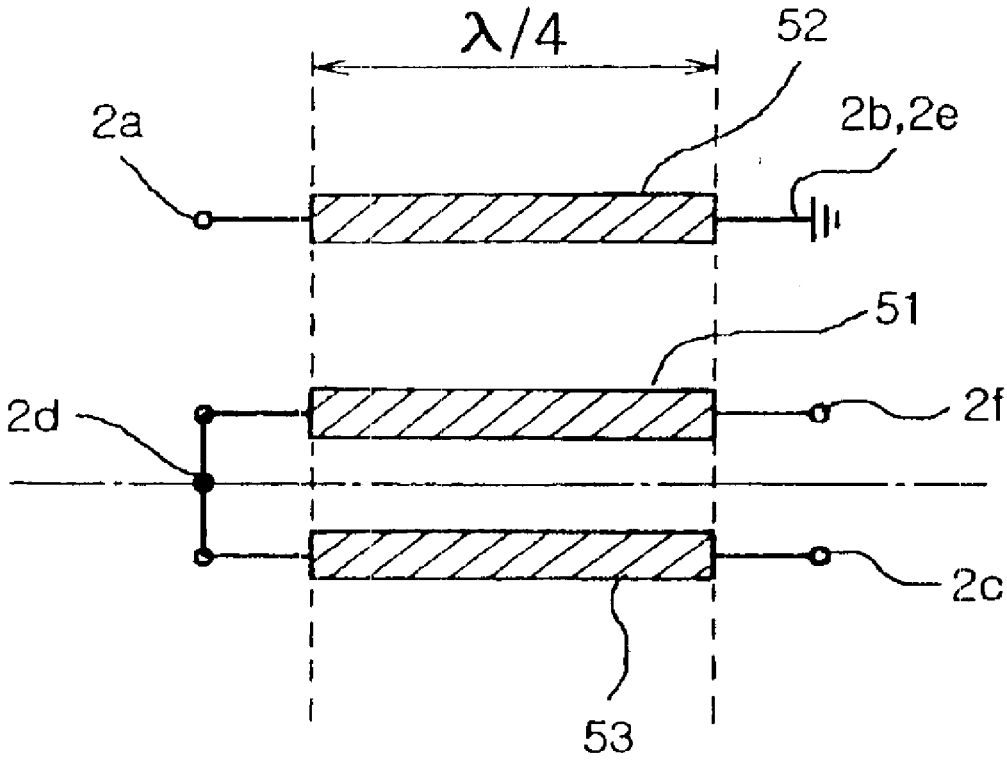
FIG. 3 is an electric equivalent circuit diagram of a laminated balun transformer in accordance with the preferred embodiment of the present invention.

FIG. 3 illustrates an electric equivalent circuit diagram corresponding to the laminated balun transformer 1 shown in FIG. 2.

The operation of the circuit shown in FIG. 3 will be described below.

When an unbalanced signal having a certain frequency is applied to the unbalanced signal input electrode 2*d* of the laminated balun transformer 1, the unbalanced signal is induced to the first strip line 51 electro-magnetically coupled to the second strip line 52, the signal induced to the first strip line 51 is transferred to the third strip line 53 through the NC electrode 2*d*, and then the signal transferred to the third strip line 53 is output through the first and second balanced output electrodes 2*c*, 2*f* in a from of a signal having the same frequency as the unbalanced signal but having a different phase from the unbalanced signal.

In accordance with the present invention, the first and second strip lines 51, 52 can be formed on the same dielectric sheet. In such case, the ground electrode 32 for decoupling the first and second strip lines 51, 51 from the third strip line 53 is not necessary, so that a structure of the laminated balun transformer may be further simplified.

Figure 4:
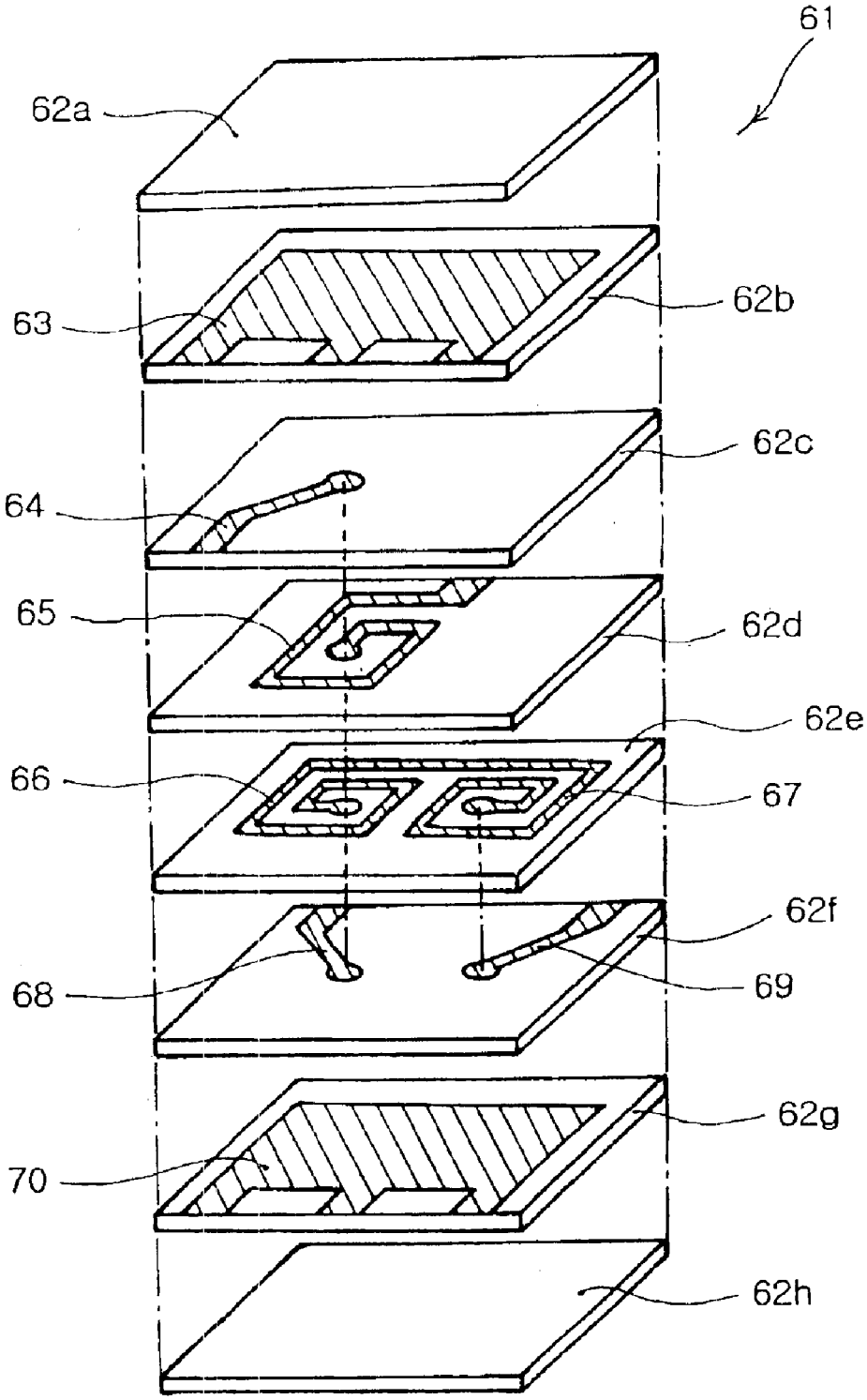
FIG. 4 is an exploded, perspective view of a laminated balun transformer in accordance with an alternative embodiment of the present invention.
Figure 6:
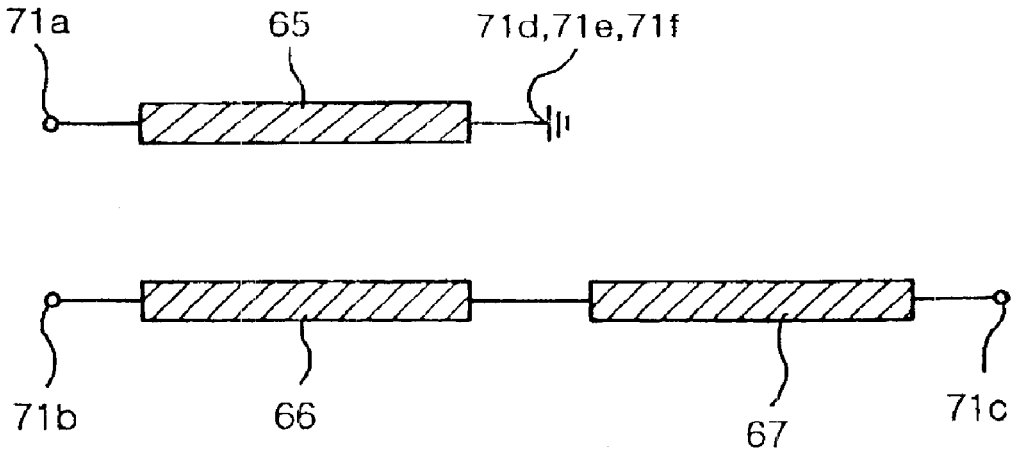
FIG. 6 illustrates an electric equivalent circuit diagram of a laminated balun transformer in accordance with the alternative embodiment of the present invention.
Figure 7:
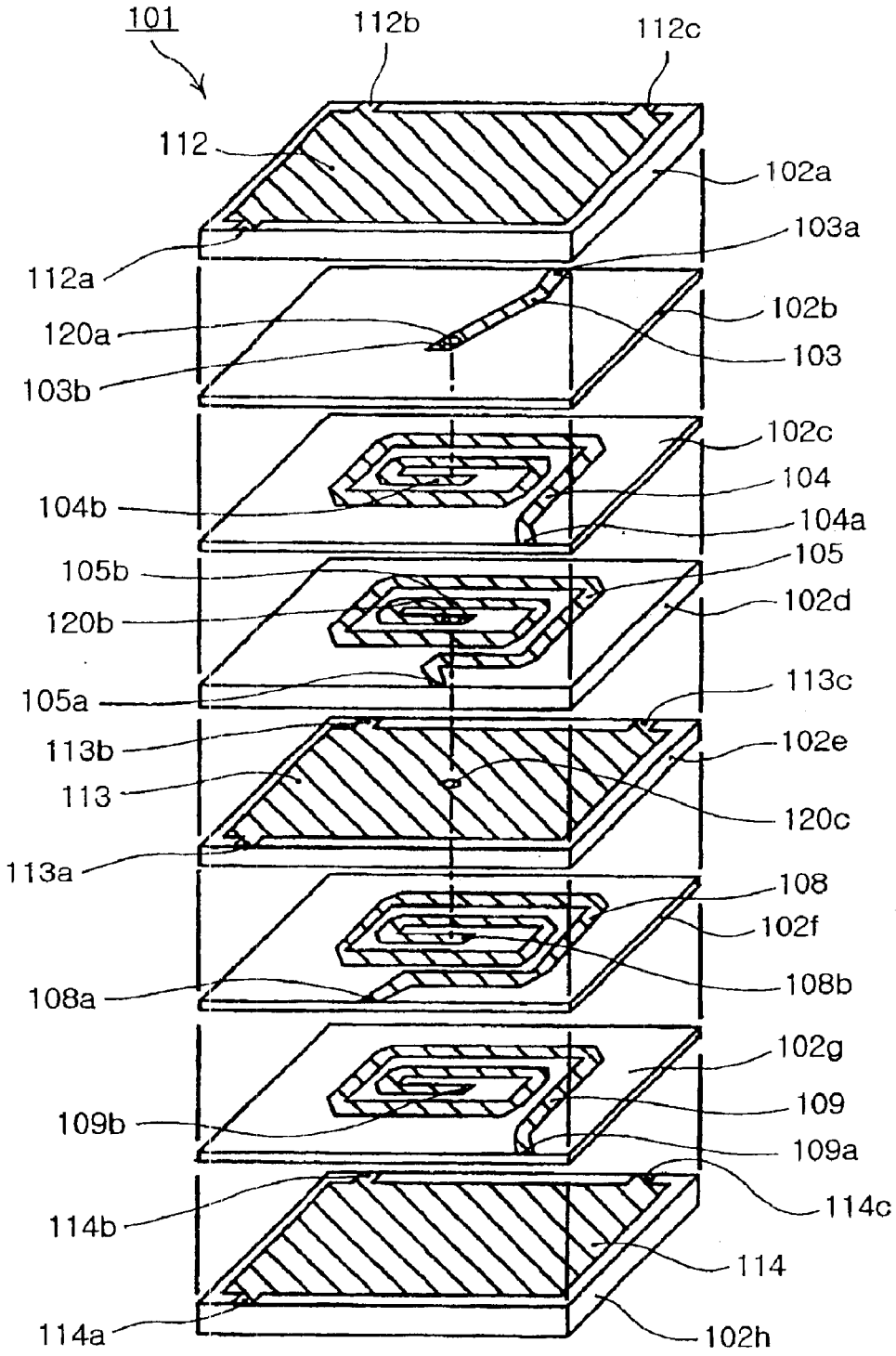
FIG. 7 PRIOR ART
FIG. 7 illustrates an exploded, perspective view of a laminated balun transformer in accordance with a prior art.
Figure 8:
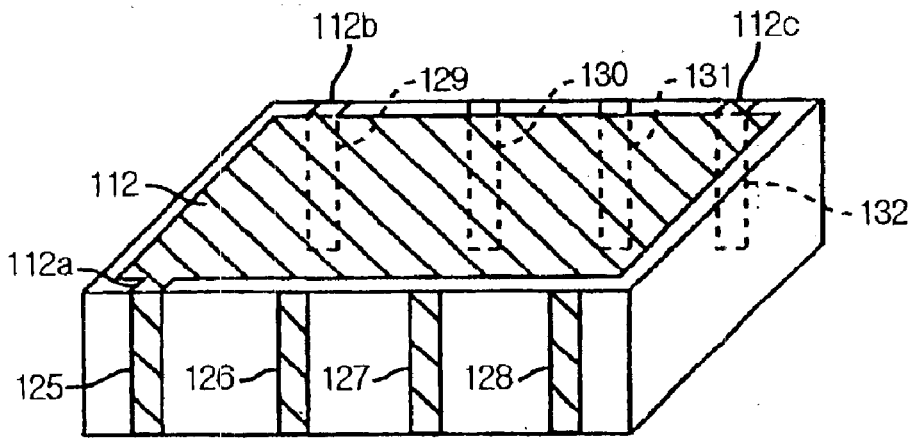
FIG. 8 PRIOR ART
FIG. 8 illustrates a perspective view of a laminated balun transformer in accordance with the prior art.
Figure 9:
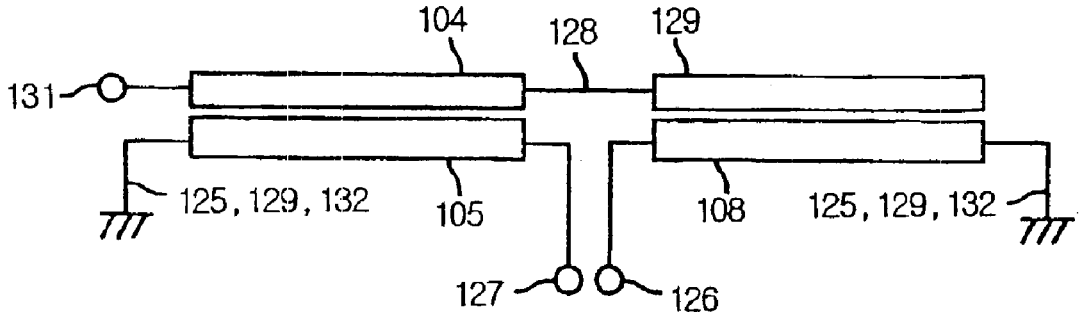
FIG. 9 PRIOR ART
FIG. 9 illustrates an electric equivalent circuit diagram of a laminated balun transformer in accordance with the prior art.

FIG. 4 illustrates an exploded view and a perspective view of a laminated balun transformer in accordance with an alternative embodiment of the present invention, and FIG. 6 illustrates an electric equivalent circuit diagram of the laminated balun transformer in accordance with the alternative embodiment of the present invention.

Figure 5:
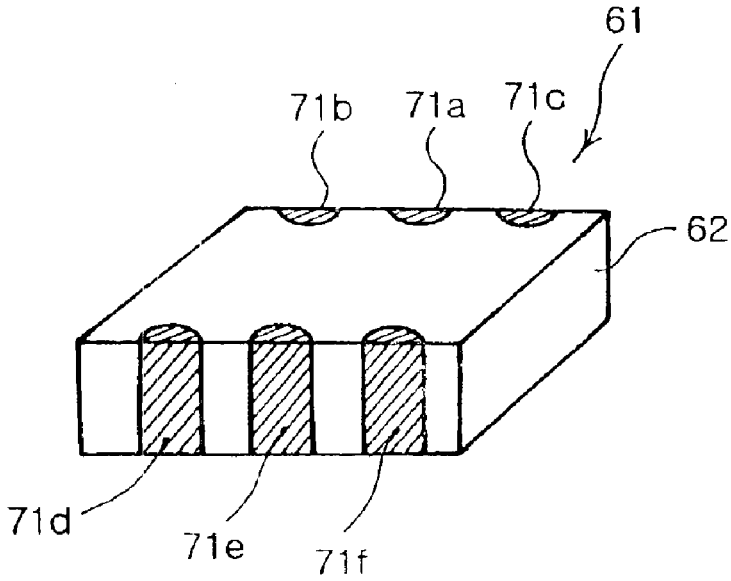
FIG. 5 illustrates a perspective view of a laminated balun transformer showing an external form thereof in accordance with the alternative embodiment of the present invention.

Referring to FIG. 4 to FIG. 6, a laminated balun transformer 61 in accordance with the alternative embodiment of the present invention comprises a dielectric block 62 having a hexahedral shape, unbalanced signal input electrode 71*a*, a first and second balanced signal output electrodes 71*b*, 71*c*, and ground electrodes 71*d*, 71*e*, 71*f* which are formed on corresponding external surfaces of the dielectric block 62.

As shown in FIG. 4, the dielectric block 62 is comprised of a dielectric sheet 62*a* which is the uppermost layer of the dielectric block 62 and has a certain thickness, a dielectric sheet 62*b* placed under the dielectric sheet 62*a* and having a ground pattern 63 thereon, which is connected to the ground electrodes 71*d*, 71*e*, 71*f*, a dielectric sheet 62*d* placed under the dielectric sheet 62*b* and having a first strip line 65 thereon, which has a first end connected to the ground electrodes 71*d*, 71*e*, 71*f* and a second end connected to the unbalanced signal electrode 71*a*. The dielectric block 62 further comprises a dielectric sheet 62*e* placed under the dielectric sheet 62*d* and being provided thereon with a second strip line 66 arranged in parallel with the first strip line 65 and connected to the first balanced signal electrode 71*b* at an end thereof and a third strip line 67 connected to the other end of the second strip line 66 and the second balanced signal electrode 71*c*. The dielectric block 62 further comprises a dielectric sheet 62*g* placed under the dielectric 62*e* an on which a ground pattern 70 connected to the ground electrodes 71*d*, 71*e*, 71*f* is provided, and a dielectric sheet 62*h* placed under the dielectric sheet 62*g* and having a certain thickness.

The dielectric block 62 may further comprise a dielectric sheet 62*c* on which a lead electrode 64 for connecting an end of the first strip line 65 to the unbalanced signal electrode 71*a* is provided, and a dielectric sheet 62*f* on which lead electrodes 68, 69 for connecting the second and third strip lines 66, 67 to the first and second balanced signal electrodes 71*b*, 71*c*, respectively, are provided.

In the laminated balun transformer shown in FIG. 4, the first strip line 65 and the second strip line 66 correspond to the second strip line 52 and the first strip line 51 in the laminated balun transformer shown in FIG. 2, respectively.

In the same manner as the laminated balun transformer shown in FIG. 2, the laminated balun transformer with reference to FIG. 4 includes only three λ/4 strip lines 65, 66, 67 instead of four λ/4 strip lines, so that the laminated balun transformer in accordance with the alternative embodiment of the present invention may be produced by a simpler fabrication process than the conventional laminated balun transformer.

Further, in accordance with the alternative embodiment of the present invention, since the second and third strip lines 66, 67 are formed on the same dielectric sheet 62*c*, the total thickness of the laminated balun transformer is reduced, so that the laminated balun transformer in accordance with the alternative embodiment of the present invention is advantageous in terms of thinness.

As described above, the laminated balun transformer in accordance with the present invention is realized by a structure including three λ/4 strip lines, thereby being advantageous in terms of easy design thereof.

Further, since the laminated balun transformer in accordance with the present invention is realized by three λ/4 strip lines, it is advantageous in terms of miniaturization and thinness, which are required properties for advanced radio frequency (RF) components.

Further, since the laminated balun transformer in accordance with the present invention is realized by a coupler and an independent λ/4 strip line, the laminated balun transformer in accordance with the present invention is advantageous in that it is less susceptible to malfunctions caused by a misalignment during a fabrication thereof, in comparison with the conventional laminated balun transformer having two couplers.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A laminated balun transformer, comprising:

a first dielectric sheet on a surface of which a first strip line is provided;

a second dielectric sheet on a surface of which a second strip line electro-magnetically coupled to the first strip line is provided;

a third dielectric sheet on a surface of which a ground electrode is provided;

a fourth dielectric sheet on a surface of which a third strip line is provided;

an unbalanced signal electrode through which an unbalanced signal is to be input or output; and first and second balanced signal electrodes through which balanced signals are to be input or output;

wherein the first strip line is connected to the ground electrode at one end thereof and connected to the unbalanced signal electrode at the other end thereof; and the second and third strip lines have respective first ends connected to each other and respective second ends connected to the first and second balanced signal electrodes, respectively.

2. The laminated balun transformer as set forth in claim 1, further comprising an external connection electrode formed on an external surface of a body formed by said dielectric sheets, wherein the second strip line and the third strip line are electrically connected to each other through the external connection electrode.

3. The laminated balun transformer as set forth in claim 2, further comprising an external ground electrode formed on the external surface of said body and connected to the around electrode of said third dielectric sheet and the grounded end of said first strip line.

4. The laminated balun transformer as set forth in claim 3, further comprising:

a fifth dielectric sheet on which a first lead electrode for connecting the first strip line to the unbalanced signal electrode is provided;

a sixth dielectric sheet on which a second lead electrode for connecting the second strip line to the first balanced signal electrode is provided; and a seventh dielectric sheet on which a third lead electrode for connecting the third strip line to the second balanced signal electrode is provided.

5. The laminated balun transformer as set forth in claim 4, further comprising eighth and ninth dielectric sheets on which further ground electrodes are provided;

wherein said eighth and ninth dielectric sheets are respectively positioned above and below a stack comprising said first, second, third, fourth, fifth, sixth, and seventh dielectric sheet.

6. The transformer of claim 1, wherein the second dielectric sheet is placed under the first dielectric sheet, the third dielectric sheet is placed under the second dielectric sheet, and the fourth dielectric sheet is placed under the third dielectric sheet.

7. The transformer of claim 1, wherein said first, second and third strip lines are $\lambda/4$ strip lines.

8. The transformer of claim 7, wherein said first and second dielectric sheets are positioned above said third dielectric sheet, and said fourth dielectric sheet is positioned below said third dielectric sheet.

9. A laminated balun transformer, comprising:

an unbalanced signal electrode through which an unbalanced signal is to be input or output;

first and second balanced signal electrodes through which balanced signals are to be input or output;

a ground electrode connected to a ground voltage;

a first dielectric sheet on which a first strip line is provided, the first strip line having one end connected to the unbalanced signal electrode and the other end connected to the ground electrode; and a second dielectric sheet on which second and third snip lines are provided, the second and third strip lines having respective first ends connected to each other and respective second ends connected to the first and second balanced signal electrodes, respectively, wherein one of the second and third strip lines is partially overlapped with the first strip line.

10. The transformer of claim 9, wherein said first, second and third strip lines are $\lambda/4$ strip lines.

11. The transformer of claim 10, wherein said first and second dielectric sheets are immediately adjacent each other without the ground electrode being interposed therebetween.

12. The transformer of claim 10, further comprising:

a third dielectric sheet on which a first lead electrode for electrically the first strip line to the ground electrode is provided; and a fourth dielectric sheet on which second and third lead electrodes for connecting the second and third strip lines to the first and second balanced signal output electrodes, respectively, are provided.

13. The transformer of claim 12, comprising two said ground electrodes provided on fifth and sixth dielectric sheets, respectively;

wherein said fifth and sixth dielectric sheets are respectively positioned above and below a stack comprising said first, second, third, and fourth dielectric sheets.

14. A laminated balun transformer, comprising:

a plurality of dielectric sheets stacked one upon another to form a body of said transformer, first, second and third $\lambda/4$ strip lines formed on at least one of said dielectric sheets;

an unbalanced signal electrode, through which an unbalanced signal is to be input or output;

first and second balanced signal electrodes, through which balanced signals are to be input or output; and a ground electrode;

wherein said first and second $\lambda/4$ strip lines are electromagnetically coupled to each other;

said first $\lambda/4$ strip line is connected to the ground electrode at one end thereof and connected to the unbalanced signal electrode at the other end thereof; and said second and third $\lambda/4$ strip lines have respective first ends electrically connected to each other and respective second ends connected to the first and second balanced signal electrodes, respectively.

15. The transformer of claim 14, wherein said transformer consists essentially of only three said $\lambda/4$ strip lines.

16. The transformer of claim 14, wherein said unbalanced signal electrode, said first and second balanced signal electrodes, and said ground electrode are formed on outer surfaces of said body.

17. The transformer of claim 14, wherein second and third $\lambda/4$ strip lines are formed on the same dielectric sheet.

18. The transformer of claim 17, wherein said first and second $\lambda/4$ strip lines are respectively formed on two dielectric sheets among said dielectric sheets, and said two dielectric sheets are positioned immediately adjacent each other without any of the remaining dielectric sheets being interposed therebetween.

19. The transformer of claim 14, wherein second and third $\lambda/4$ strip lines are formed on two dielectric sheets among said dielectric sheets; and said two dielectric sheets are separated by a ground pattern electrically connected to said ground electrode.

20. The transformer of claim 14, further comprising two internal ground electrodes provided on an upper one and a lower one of said dielectric sheets, said upper and lower dielectric sheets are respectively positioned above and below all said first, second, and third $\lambda/4$ strip lines.

* * * * *